US010060041B2

(12) United States Patent
Sista et al.

(10) Patent No.: US 10,060,041 B2
(45) Date of Patent: Aug. 28, 2018

(54) BORIDED METALS AND DOWNHOLE TOOLS, COMPONENTS THEREOF, AND METHODS OF BORONIZING METALS, DOWNHOLE TOOLS AND COMPONENTS

(71) Applicant: Baker Hughes Incorporated, Houston, TX (US)

(72) Inventors: Vivekanand Sista, The Woodlands, TX (US); Jimmy W. Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 741 days.

(21) Appl. No.: 14/561,518

(22) Filed: Dec. 5, 2014

(65) Prior Publication Data

US 2016/0160370 A1 Jun. 9, 2016

(51) Int. Cl.

| | |
|---|---|
| ***E21B 41/00*** | (2006.01) |
| ***C25D 3/66*** | (2006.01) |
| ***C25D 9/06*** | (2006.01) |
| ***C25D 11/00*** | (2006.01) |

(52) U.S. Cl.

CPC ..... *C25D 3/66* (2013.01); *C25D 9/06* (2013.01); *C25D 11/00* (2013.01); *E21B 41/00* (2013.01)

(58) Field of Classification Search

CPC ..... E21B 41/00

See application file for complete search history.

(56) References Cited

U.S. PATENT DOCUMENTS

| | | | | |
|---|---|---|---|---|
| 3,697,390 | A | 10/1972 | Schlain et al. | |
| 3,775,271 | A | 11/1973 | Gomes et al. | |
| 3,827,954 | A | 8/1974 | Mc et al. | |
| 3,880,729 | A | 4/1975 | Kellner et al. | |
| 3,983,013 | A | 9/1976 | Gutman et al. | |
| 4,684,448 | A * | 8/1987 | Itoh | C25C 7/005 205/365 |
| 6,458,218 | B1 | 10/2002 | Savich | |
| 6,478,887 | B1 * | 11/2002 | Sue | C23C 8/08 148/279 |
| 2010/0018611 | A1 | 1/2010 | Timur et al. | |

(Continued)

FOREIGN PATENT DOCUMENTS

| | | | |
|---|---|---|---|
| EP | 2423164 | A1 | 2/2012 |
| JP | 06033220 | A | 2/1994 |

OTHER PUBLICATIONS

Kaptay et al., Electrochemical Synthesis of Refractory Borides from Molten Salts, Plasmas & Ions, vol. 2, (1999), pp. 45-46.

(Continued)

*Primary Examiner* — Robert E Fuller
*Assistant Examiner* — David Carroll
(74) *Attorney, Agent, or Firm* — TraskBritt

(57) ABSTRACT

A method of boriding a metal comprises forming a molten electrolyte comprising between about five weight percent and about fifty weight percent boron oxide, and contacting at least a portion of a metal with the molten electrolyte. Electrical current is applied to at least a portion of the metal while maintaining a temperature of the molten electrolyte below about 700° C. to diffuse boron atoms from the molten electrolyte into a surface of the at least a portion of the metal. A downhole tool including at least one borided component is also disclosed.

19 Claims, 3 Drawing Sheets

(56) References Cited

U.S. PATENT DOCUMENTS

2010/0147504 A1* 6/2010 King ..... E21B 43/119 166/55
2010/0224498 A1 9/2010 Ürgen et al.
2011/0287270 A1 11/2011 Tsurumi et al.
2013/0056363 A1* 3/2013 Timur ..... C23C 8/42 205/231
2014/0096858 A1* 4/2014 Nam ..... F16L 57/06 138/145
2015/0060051 A1* 3/2015 Sista ..... E21B 17/1085 166/242.4
2015/0107582 A1* 4/2015 Jin ..... G02B 1/005 126/676
2015/0225834 A1* 8/2015 Pham ..... C23C 8/42 148/241
2015/0252661 A1* 9/2015 Glass ..... E21B 43/267 166/308.1
2015/0292303 A1* 10/2015 Dusseault ..... E21B 41/0064 166/268
2016/0024877 A1* 1/2016 Coronado ..... E21B 33/16 166/177.4
2017/0250057 A1* 8/2017 Simpson ..... C04B 35/645

OTHER PUBLICATIONS

Oliveira et al., Evaluation of Hard Coatings Obtained on AISI D2 Steel by Thermo-Reactive Deposition Treatment, Surface and Coatings Technology, vol. 201, (2006), pp. 1880-1885.
Sen et al., An Approach to Kinetic Study of Borided Steels, Surface & Coatings Technology, vol. 191, (2005), pp. 274-285.
Sista et al., Electrochemical Bonding and Characterization of AISI D2 Tool Steel, Thin Solid Films, vol. 520, (2011), pp. 1582-1588.
Sista et al., U.S. Appl. No. 14/019,096 titled Methods of Forming Borided Downhole Tools, and Related Downhole Tools, filed Sep. 5, 2013.
Sista et al., U.S. Appl. No. 14/019,132 titled Methods of Forming Borided Down-Hole Tools, and Related Down-Hole Tools, filed Sep. 5, 2013.
International Search Report and Written Opinion for International Application No. PCT/US2015/064067 dated Apr. 1, 2016, 9 pages.

* cited by examiner

BORIDED METALS AND DOWNHOLE TOOLS, COMPONENTS THEREOF, AND METHODS OF BORONIZING METALS, DOWNHOLE TOOLS AND COMPONENTS

TECHNICAL FIELD

Embodiments of the disclosure relate generally to methods of boronizing metals and components for downhole tools and other assemblies. More particularly, embodiments of the disclosure relate to methods of boronizing downhole components and tools by electrochemical boronizing and to related components and downhole tools incorporating same.

BACKGROUND

Wellbores are formed in subterranean formations for various purposes including, for example, extraction of oil and gas from the subterranean formations and extraction of geothermal heat from the subterranean formations. Wellbores can exhibit extremely aggressive environments. For example, wellbores can exhibit abrasive surfaces, can be filled with corrosive chemicals (e.g., caustic drilling muds, well fluids, such as salt water, crude oil, carbon dioxide, and hydrogen sulfide, etc.), and can exhibit increasing high temperatures and pressures at progressively deeper "downhole" locations.

The extremely aggressive environments of wellbores can rapidly degrade the materials of components of tools, and other assemblies used in various downhole applications (e.g., drilling applications, conditioning applications, logging applications, measurement applications, monitoring applications, exploring applications, etc.). Such degradation limits operational efficiency of these components, tools and assemblies, and results in undesirable repair and replacement costs. Accordingly, there is a continuing need for downhole tools and assemblies having components exhibiting material characteristics capable of withstanding such extremely aggressive environments, as well as for methods of forming such downhole components, tools, and assemblies.

One approach toward forming downhole components, tools, and assemblies capable of withstanding such extremely aggressive environments of wellbores includes boronizing the downhole components, tools, and assemblies. Boronizing, also known as "boriding," is a thermal diffusion process in which boron atoms diffuse into surfaces of a metal to form metal borides exhibiting relatively enhanced properties (e.g., thermal resistance, hardness, toughness, chemical resistance, abrasion resistance, corrosion resistance, reduction in friction coefficient, mechanical strength, etc.) as compared to the metal. Unfortunately, however, conventional methods of boriding components for downhole tools and assemblies can be cost-prohibitive and expose the downhole components to undesirably high temperatures. For example, conventional methods of boriding components for downhole tools and assemblies can be time consuming (e.g., powder pack boriding, gas boriding, and fluidized bed boriding processes requiring from about 8 hours to about 10 hours of processing time; plasma boriding processes requiring from about 15 hours to about 25 hours of processing time; molten salt boriding processes requiring from about 6 hours to about 8 hours of processing time; etc.), and can include exposing the downhole components to elevated temperatures that may alter a shape of a borided component or cause dimensions of the component to fall outside of engineering tolerances (e.g., such as by warping the component). Such high temperatures may also cause undesirable degradation of certain materials, which may be present in or on the component, tool, or assembly being borided.

It would, therefore, be desirable to have new methods, systems, and apparatuses for boriding components for downhole tools and assemblies that are simple, fast, cost-effective, and meet engineering tolerances as compared to conventional methods, systems, and apparatuses for boriding downhole components, tools, and assemblies. Such methods, systems, and apparatuses may facilitate increased adoption and use of borided components, tools, and assemblies in downhole applications.

BRIEF SUMMARY

Embodiments disclosed herein include methods of boriding components for downhole tools, and related components and downhole tools incorporating such components. For example, in accordance with one embodiment described herein, a method of boriding a metal comprises forming a molten electrolyte comprising between about five weight percent and about fifty weight percent boron oxide, contacting at least a portion of a metal with the molten electrolyte, and applying electrical current to the at least a portion of the metal while maintaining a temperature of the molten electrolyte below about 700° C. to diffuse boron atoms from the molten electrolyte into a surface of the at least a portion of the metal.

In additional embodiments, a method of surface treating a downhole tool component comprises at least partially inserting at least one component comprising metal at least partially into a molten electrolyte comprising between about five weight percent and about thirty weight percent $B_2O_3$ and between about seventy weight percent and about ninety-five weight percent of at least one of LiOH, NaOH, KOH, CsOH, $Mg(OH)_2$, $Ca(OH)_2$, $Ba(OH)_2$, LiCl, NaCl, KCl, $MgCl_2$, $CaCl_2$, $Li_2CO_3$, $Na_2CO_3$, $K_2CO_3$, $Cs_2CO_3$, $MgCO_3$, $CaCO_3$, and $BaCO_3$, and diffusing boron from the molten electrolyte into a surface of the at least one component to form a metal boride on the surface of the at least one component while applying electrical current to the at least one component.

In yet additional embodiments, a downhole tool comprises at least one borided component comprising a metal and having a surface treated by the method comprising forming a molten electrolyte comprising between about five weight percent and about fifty weight percent boron oxide, contacting at least a portion of a downhole tool component with the molten electrolyte, and applying electrical current to the at least a portion of the downhole tool component while maintaining a temperature of the molten electrolyte below about 700° C. to diffuse boron atoms from the molten electrolyte into a surface of the at least a portion of the downhole tool component.

BRIEF DESCRIPTION OF THE DRAWINGS

While the specification concludes with claims particularly pointing out and distinctly claiming what are regarded as embodiments of the invention, advantages of the invention can be more readily ascertained from the following detailed description when read in conjunction with the accompanying drawings in which:

DETAILED DESCRIPTION

Figure 1:
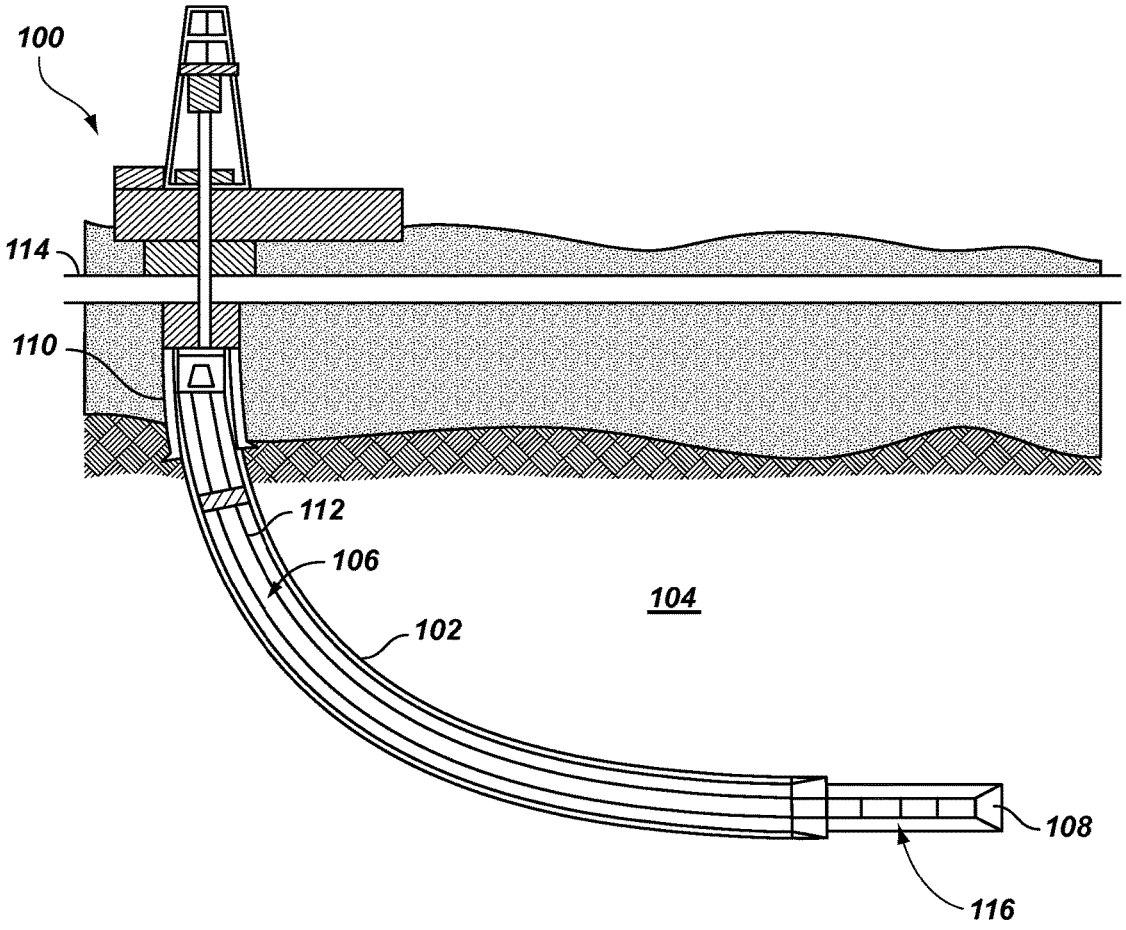
FIG. 1 is a simplified, schematic illustration of a borided downhole assembly, formed in accordance with an embodiment of the disclosure, disposed within a wellbore.

Illustrations presented herein are not meant to be actual views of any particular material, component, or system, but are merely idealized representations that are employed to describe embodiments of the disclosure.

The following description provides specific details, such as material types, compositions, material thicknesses, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional techniques employed in the industry. In addition, the description provided below does not form a complete process flow for boronizing components of downhole tools. Only those process acts and structures necessary to understand the embodiments of the disclosure are described in detail below. A person of ordinary skill in the art will understand that some process components are inherently disclosed herein and that adding various conventional process components and acts would be in accord with the disclosure. Additional acts or materials to boronize a downhole component may be performed by conventional techniques.

As used herein, the terms "boronizing" and "boriding" are used interchangeably and refer to a thermal diffusion process in which boron atoms diffuse into a surface of a metal to form metal borides.

As used herein, the term "and/or" includes any and all combinations of one or more of the associated listed items.

Methods of boriding metals including downhole structures such as components, tools, and assemblies are described, as are related components, downhole tools and assemblies. The downhole tools may be borided at relatively low temperatures without altering a material property (e.g., a shape, a contour, a cutting dimension, a critical dimension, a surface, etc.) of the downhole tool. For example, in some embodiments, a method of boriding a component of a downhole tool includes contacting at least a portion of the component with a molten electrolyte comprising a boron oxide and at least one other material. The boron oxide constitutes between about five weight percent and about fifty weight percent of the molten electrolyte and the other material constitutes between about fifty weight percent and about ninety-five weight percent of the molten electrolyte. A melting point of the molten electrolyte may be as low as about 400° C. by selecting the composition of the molten electrolyte such that boron oxide constitutes between about five weight percent and about fifty weight percent of the molten electrolyte, and such that the other material constitutes between about fifty weight percent and about ninety-five weight percent of the molten electrolyte. The weight percent of the boron oxide within the molten electrolyte may be less than a weight percent of the at least another material in the molten electrolyte. An electrical current may be applied to at least a portion of the downhole component to boronize the at least one downhole component. The resulting borided downhole component may comprise at least one metal boride material of a metal of the downhole component. Accordingly, a downhole tool may be borided without exposing the downhole tool to temperatures above about 700° C. while maintaining a critical dimension of the borided downhole tool. Depending on the molten electrolyte composition, the boronizing may occur at a temperature below about 650° C., below about 600° C., below about 550° C., below about 500° C., below about 450° C., or below about 400° C.

Although some embodiments of the disclosure are depicted as being used and employed in particular downhole assemblies and components thereof, persons of ordinary skill in the art will understand that the embodiments of the disclosure may be employed in any downhole component, tool, or assembly in which it is desirable to enhance at least one of wear resistance, thermal resistance, and chemical resistance. Such downhole components, tools, and assemblies may be used in, for example, drilling, conditioning, completion, logging, measurement, and monitoring of wellbores. By way of non-limiting example, embodiments of the disclosure may be employed in earth-boring rotary drill bits, a tooth of a drill bit, a cutting structure of a drill bit, a core bit, a completion tool, an expandable reamer, a fixed-blade reamer, an expandable stabilizer, a fixed stabilizer, a slip-on stabilizer, a clamped-on stabilizer, an integral stabilizer, an optimized rotational density tool, a slimhole neutron density tool, a calibrated neutron density tool, a drill motor, a bearing, an upper bearing housing, a lower bearing housing, a rotor, a stator, a pump, a valve, wellbore pipe, wellbore liner, and equipment, assemblies, and components for downhole completion, production, maintenance, and remediation.

FIG. 1 is a simplified, schematic representation of a downhole assembly 100 that may include at least one borided component for use during the formation of a wellbore 102 within a subterranean formation 104, after the formation of the wellbore 102, or both. As shown in FIG. 1, the downhole assembly 100 may be provided into the wellbore 102 below a surface 114 of the subterranean formation 104. A portion of the wellbore 102 may be lined with casing 110. The downhole assembly 100 may include a drill string 106 extending into the subterranean formation 104. The drill string 106 may include a tubular member 112 that carries a bottomhole assembly 116 at a distal end thereof. At least one component of the bottomhole assembly 116, such as a borided downhole tool 108, may be formed in accordance with methods described herein. In some embodiments, the borided downhole tool 108 comprises an earth-boring rotary drill bit including one or more of at least one borided internal surface (e.g., a borided bearing surface), and at least one borided external surface (e.g., a borided bit body surface, such as a borided bit blade surface).

The borided downhole tool 108 may comprise any component associated with a downhole tool and/or assembly. Accordingly, the borided downhole tool 108 may exhibit a desired shape (i.e., geometric configuration) and size, such as a shape and size associated with a conventional component of a downhole tool. For example, the borided downhole tool 108 may exhibit a conical shape, a tubular shape, a pyramidal shape, a cubical shape, a cuboidal shape, a spherical shape, a hemispherical shape, a cylindrical shape, a semi cylindrical shape, truncated versions thereof, or an irregular shape. Irregular shapes include complex shapes, such as shapes associated with downhole tools and downhole assemblies. In some embodiments, the borided downhole tool 108 exhibits the shape of a component (e.g., an internal component, such as a bearing; or an external component, such as a blade, wear insert, cutting element, roller cone, roller cone insert, etc.) of a earth-boring rotary drill bit (e.g., a fixed-cutter drill bit, a roller cone drill bit, a hybrid drill bit employing both fixed and rotatable cutting structures, a core drill bit, an eccentric drill bit, a bicenter drill bit, etc.), a tooth of a drill bit, a cutting structure of a drill bit, a core bit, a completion tool (e.g., a packer, a screen, a bridge plug, a latch, a shoe, a nipple, a barrier, a sleeve, a valve, a pump, etc.), an expandable reamer, a fixed blade reamer, an expandable stabilizer, a fixed stabilizer, a slip-on stabilizer, a clamped-on stabilizer, an integral stabilizer, an OnTrak™ tool, an optimized rotational density tool, an AziOnTrak™ tool, a slimhole neutron density tool, a calibrated neutron density tool, a drill motor, a bearing, an upper bearing housing, a lower bearing housing, a mud motor, a rotor, a stator, a pump, a valve, or equipment, assemblies, and components for downhole completion, production, maintenance, and remediation.

An embodiment of the disclosure will now be described with reference to FIG. 2, which illustrates a simplified cross-sectional view of a configuration that may be used in a method of boriding a downhole component (e.g., at least one borided component of the borided downhole tool 108 previously described with reference to FIG. 1) for a downhole tool and/or assembly. The method includes providing a molten electrolyte 206, at least one downhole component 202, and one or more anodes 212 into a crucible 204 to form an electrochemical cell 200. Electrical current is then applied to the electrochemical cell 200 to boronize the downhole component 202. With the description as provided below, it will be readily apparent to one of ordinary skill in the art that the method described herein may be used in various applications. In other words, the method may be used whenever it is desired to boronize a component for a downhole application (e.g., a drilling application, a conditioning application, a logging application, a measurement application, a monitoring application, etc.).

The crucible 204 may be any vessel or container suitable for holding the molten electrolyte 206 before, during, and after the electrochemical boriding process of the disclosure, as described in further detail below. By way of non-limiting example, the crucible 204 may comprise a silicon carbide (SiC) crucible configured to receive and hold the molten electrolyte 206, the downhole component 202, and the one or more anodes 212. In additional embodiments, the crucible 204 may be formed of and include nitride bonded SiC bricks. In further embodiments, the crucible 204 may be formed of and include an electrically conductive material that may serve as an anode during the electrochemical boronizing process. For example, the crucible 204 may be formed of and include a graphite material. The crucible 204 may be operatively associated with (e.g., connected to) at least one heating device (e.g., combustion heater, electrical resistance heater, inductive heater, electromagnetic heater, etc.) configured and operated to achieve and/or maintain a desired temperature of the molten electrolyte 206. In some embodiments, the crucible 204 includes a similar shape as the downhole component 202 but may be larger than the downhole component 202 to receive the downhole component 202 therein. By way of non-limiting example, the downhole component 202 may include an earth-boring bit and the crucible may be shaped and configured to conform around the earth-boring bit, with space between the earth-boring bit and inner walls of the crucible 204 for the molten electrolyte 206.

The molten electrolyte 206 may include at least one boron-containing material formulated for diffusing boron (B) atoms within the downhole component 202 during the electrochemical boronizing process, as described in further detail below. For example, the molten electrolyte 206 may include an anhydrous boron oxide such as anhydrous boron trioxide ($B_2O_3$). Other boron-containing materials that may be employed include boric acid, a borate of an element of Group I elements (e.g., lithium, sodium, potassium) or Group II elements (e.g., magnesium, calcium, strontium, barium) of the Periodic Table of the Elements. The molten electrolyte 206 may include a molten mixture of the boron-containing material (e.g., $B_2O_3$) and at least one other material, such as at least one of lithium hydroxide (LiOH), sodium hydroxide (NaOH), potassium hydroxide (KOH), cesium hydroxide (CsOH), magnesium hydroxide ($Mg(OH)_2$), calcium hydroxide ($Ca(OH)_2$), barium hydroxide ($Ba(OH)_2$), lithium chloride (LiCl), sodium chloride (NaCl), potassium chloride (KCl), magnesium chloride ($MgCl_2$), calcium chloride ($CaCl_2$), lithium carbonate ($Li_2CO_3$), sodium carbonate ($Na_2CO_3$), potassium carbonate ($K_2CO_3$), cesium carbonate ($Cs_2CO_3$), magnesium carbonate ($MgCO_3$), and calcium carbonate ($CaCO_3$), and barium carbonate ($BaCO_3$). The at least one other material may be selected to alter a melting point and a conductivity of the molten electrolyte 206. By way of example, an increasing weight percent of the at least one other material in the molten electrolyte 206 may increase the conductivity of the molten electrolyte 206. The molten electrolyte 206 may include a higher weight percent of the at least one other material than of the boron-containing material. In some embodiments, the molten electrolyte 206 consists essentially of the boron-containing material and the at least one other material. In some embodiments, the molten electrolyte 206 includes only the boron-containing material and the at least one other material, and does not include the metal to be boronized or salts thereof.

The boron-containing material may constitute between about five weight percent and about fifty weight percent of the molten electrolyte 206, such as between about five weight percent and about ten weight percent, between about ten weight percent and about twenty weight percent, between about twenty weight percent and about thirty weight percent, between about thirty weight percent and about forty weight percent, or between about forty weight percent and about fifty weight percent of the molten electrolyte 206.

The at least one other material may constitute between about fifty weight percent and about ninety-five weight percent of the molten electrolyte 206, such as between about fifty weight percent and about sixty weight percent, between about sixty weight percent and about seventy weight percent, between about seventy weight percent and about eighty weight percent, between about eighty weight percent and above ninety weight percent, or between about ninety weight percent and about ninety-five weight percent of the molten electrolyte 206.

Forming the molten electrolyte 206 to include a lower weight percent of the boron-containing material than the at least one other material may enable the boriding process to occur at a lower temperature than conventional electrochemical boronizing processes. The composition of the molten electrolyte 206 (e.g., the weight percent of $B_2O_3$ and the weight percent of the at least one other material) may be selected to impart a low melting point to the molten electrolyte 206. Surprisingly, a molten electrolyte 206 constituting a lower weight percent of the boron-containing material (e.g., between about five weight percent and about fifty weight percent of $B_2O_3$) may not decrease a rate of boronization in any significant manner, but may advantageously enable thermal diffusion and boronization at lower temperatures than prior art molten electrolytes comprised of a higher weight percent of the boron-containing material. Accordingly, the molten electrolyte 206 described herein, may include a weight percent of the boron-containing material as low as about five weight percent and may exhibit an economical boronization rate at a relatively low temperature (e.g., as low as about 400° C.). Therefore, a component of a downhole tool, may advantageously be boronized without exposing the component to elevated temperatures that may cause the downhole tool to lose desired properties (e.g., warp) as a result of exposure to higher temperatures.

A temperature of the molten electrolyte 206 may be maintained between about 400° C. and about 700° C., such as between about 400° C. and about 450° C., between about 450° C. and about 500° C., between about 500° C. and about 550° C., between about 550° C. and about 600° C., between about 600° C. and about 650° C., or between about 650° C. and about 700° C. The temperature of the molten electrolyte 206 may at least partially depend on the material composition of the molten electrolyte 206. The temperature of the molten electrolyte 206 may be at or above a melting point temperature of a solid precursor to the molten electrolyte 206. The melting point and the temperature of the molten electrolyte 206 may be tailored based on the composition of the molten electrolyte 206. By way of example, the melting point of the molten electrolyte 206 may be tailored to exhibit a lower melting point (e.g., between about 400° C. and about 450° C., or between about 450° C. and about 500° C.) by selecting the at least one other material to exhibit a lower melting point than the boron-containing material. By way of non-limiting example, the another material may include NaOH, KOH, CsOH, $Mg(OH)_2$, $Ba(OH)_2$, and combinations thereof.

As a non-limiting example, in some embodiments in which the molten electrolyte 206 includes, for example, from about five weight percent to about fifty weight percent $B_2O_3$, the temperature of the molten electrolyte 206 may be between about 400° C. and about 700° C. As another non-limiting example, in embodiments in which the molten electrolyte 206 includes between about five weight percent and about fifty weight percent $B_2O_3$, and the at least one other material includes a hydroxide (e.g., LiOH, NaOH, KOH, CsOH, $Mg(OH)_2$, $Ca(OH)_2$, $Ba(OH)_2$) constituting between about fifty weight percent and about ninety-five weight percent of the molten electrolyte 206, the temperature of the molten electrolyte 206 may be between about 400° C. and about 500° C., such as between about 400° C. and about 450° C. or between about 450° C. and about 500° C. In yet another non-limiting example in which the molten electrolyte 206 includes between about five weight percent and about thirty weight percent $B_2O_3$ and between about seventy weight percent and about ninety-five weight percent of the at least one other material, the temperature of the molten electrolyte 206 may be between about 400° C. and about 700° C. In yet other embodiments, the molten electrolyte 206 may include about thirty weight percent $B_2O_3$ and about seventy weight percent of the at least one other material, which may include, for example, NaOH, KOH, CsOH, $Mg(OH)_2$, $Ba(OH)_2$, and combinations thereof.

The molten electrolyte 206 may be formed within the crucible 204 (e.g., by heating the crucible 204 at least to the melting point of a solid precursor to the molten electrolyte 206), or may be formed outside the crucible 204 and then delivered into the crucible 204.

The one or more anodes 212 may be formed of and include an electrically conductive material capable of withstanding the conditions (e.g., temperatures, materials, etc.) within the crucible 204. By way of non-limiting example, each of the anodes 212 may be formed of and include graphite. In embodiments where the crucible 204 is configured to serve as an anode (e.g., where the crucible 204 is formed of and includes graphite), one or more of the anodes 212 may, optionally, be omitted. While FIG. 2 illustrates the electrochemical cell 200 as including two anodes 212, the electrochemical cell 200 may, alternatively, include a different number of anodes 212. The number of anodes 212 provided within the molten electrolyte 206 may at least partially depend on the number of downhole components 202 provided within the molten electrolyte 206. As a non-limiting example, if more than one downhole component 202 is provided within the molten electrolyte 206, more than one anode 212 may also be provided within the molten electrolyte 206. In some embodiments in which more than one downhole component 202 is provided within the molten electrolyte 206, adjacent anodes 212 may be separated by at least one downhole component 202 (e.g., each downhole component 202 may comprise or be attached to a cathode of the electrochemical cell 200 and may be disposed between at least two anodes 212). In yet other embodiments, a plurality of anodes 212 may surround the downhole component 202. By way of non-limiting example, the anodes 212 may be shaped and configured to conform to a shape of the downhole component 202 (e.g., may be shaped and configured to conform to a shape of a pump, a rotor, an earth-boring bit, etc.).

Figure 2:
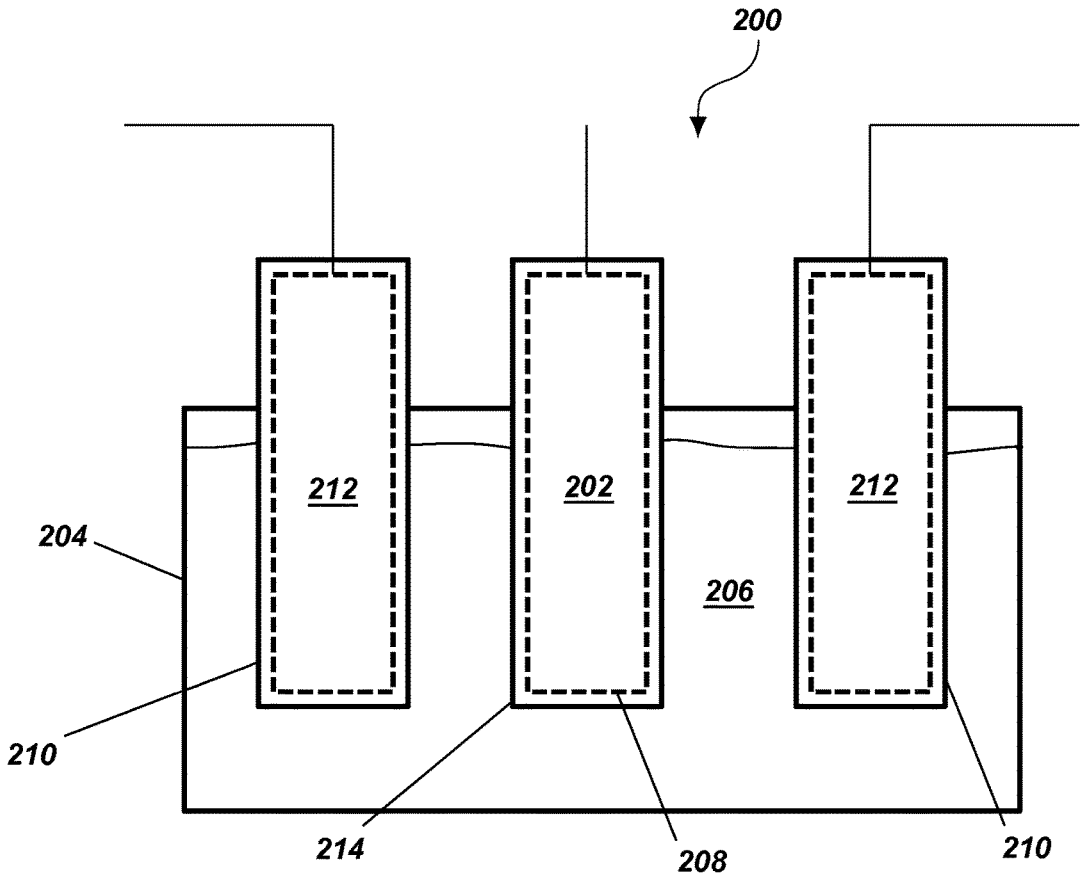
FIG. 2 is a simplified cross-sectional view of an electrochemical cell for producing a borided downhole component, in accordance with embodiments of the disclosure.

As depicted in FIG. 2, the anodes 212 may be electrically connected (e.g., directly connected, or indirectly connected) to fixtures 210 configured (e.g., sized and shaped) to position, and hold or contain the anodes 212 within the crucible 204. The anodes 212 may be integral with their respective fixtures 210 (i.e., at least one of the anodes 212 and at least one of the fixtures 210 may comprise a single structure), or may be discrete from their respective fixtures 210 (i.e., at least one of the anodes 212 and at least one of the fixtures 210 may comprise different, connected structures). If the anodes 212 and their respective fixtures 210 are discrete structures, the fixtures 210 and the anodes 212 may be formed of and include the same material, or may be formed of and include different materials (e.g., different electrically conductive materials). In addition, if discrete structures, the anodes 212 and their respective fixtures 210 may be coupled to one another.

As depicted in FIG. 2, the downhole component 202 may be electrically connected (e.g., directly connected, or indirectly connected) to at least one fixture 214 configured (e.g., sized and shaped) to position, and hold or contain the downhole component 202 within the crucible 204. The fixture 214 may be formed of and include an electrically conductive material capable of withstanding the conditions (e.g., temperature, materials, etc.) within the crucible 204.

While various embodiments herein describe or illustrate a single downhole component 202 within the crucible 204, multiple downhole components 202 may be provided within the crucible 204. The multiple downhole components 202 may be held by a single fixture (e.g., the fixture 214) within the crucible 204, or may be held by multiple fixtures within the crucible 204. Each of the downhole components 202 may be substantially the same, or at least one of the downhole components 202 may be different than at least one other of the downhole components 202. Providing multiple downhole components 202 within the crucible 204 may facilitate the simultaneous boriding of multiple downhole tools and/or assemblies. By way of non-limiting example, the crucible 204 may be at least partially filled with a plurality of downhole components 202 such that at least a portion of each of the downhole components 202 is borided during subsequent electrochemical boronizing processing.

The downhole component 202 may be at least partially formed of (e.g., a laminate or other composite structure) and include a metal material capable of forming a hard, wear resistant (e.g., abrasion resistant, erosion resistant), and chemically resistant (e.g., corrosion resistant) metal boride material when subjected to the electrochemical boronizing process of the disclosure. The downhole component 202 may, for example, be at least partially formed of and include iron (Fe), cobalt (Co), nickel (Ni), copper (Cu), tungsten (W), Rhenium (Re), titanium (Ti), molybdenum (Mo), niobium (Nb), vanadium (V), hafnium (Hf), tantalum (Ta), chromium (Cr), zirconium (Zr), aluminum (Al), silicon (Si), carbides thereof, nitrides thereof, oxides thereof, alloys thereof, or combinations thereof. The downhole component 202 may serve as a cathode of the electrochemical cell 200.

As a non-limiting example, the downhole component 202 may be formed of and include a metal alloy, such as at least one of an Fe-containing alloy, a Ni-containing alloy, a Co-containing alloy, an Fe- and Ni-containing alloy, a Co- and Ni-containing alloy, an Fe- and Co-containing alloy, an Al-containing alloy, a Cu-containing alloy, a Mg-containing alloy, and a Ti-containing alloy. In some embodiments, the downhole component 202 is formed of and includes a Fe-containing alloy (e.g., a steel-alloy). Suitable Fe-containing alloys are commercially available from numerous sources, such as from Special Metals Corp., of New Hartford, N.Y., under the trade name INCONEL® (e.g., INCONEL® 945, INCONEL® 925, INCONEL® 745, INCONEL® 718, INCONEL® 600, etc.), and from Schoeller Bleckmann Sales Co. of Houston, Tex. (e.g., P550 alloy steel, P650 alloy steel, P750 alloy steel, etc.). The downhole component 202 may, for example, be formed of and include at least one of AISI 4815 alloy steel, AISI 4130M7 alloy steel, AISI 4140 alloy steel, AISI 4145H alloy steel, AISI 4715 alloy steel, AISI 8620 alloy steel, AISI 8630 alloy steel, SAE PS55 alloy steel, P550 alloy steel, P650 alloy steel, P750 alloy steel, INCONEL® 945, INCONEL® 925, and INCONEL® 745. In some embodiments, the downhole component 202 is formed of and includes at least one of AISI 4815 alloy steel, and AISI 4140 alloy steel.

As an additional non-limiting example, the downhole component 202 may be formed of and include a ceramic-metal composite material (i.e., a "cermet" material). The ceramic-metal composite material may include hard ceramic phase particles (or regions) dispersed throughout a matrix of metal material. The hard ceramic phase particles may comprise carbides, nitrides, and/or oxides, such as carbides of at least one of W, Re, Ti, Mo, Nb, V, Hf, Ta, Cr, Zr, Al, and Si. For example, the hard ceramic phase particles may comprise one or more of tungsten carbide (WC), fused tungsten carbide ($WC/W_2C$ eutectic), rhenium carbide (ReC), titanium carbide (TiC), tantalum carbide (TaC), chromium carbide (CrC), titanium nitride (TiN), aluminum oxide ($Al_2O_3$), aluminum nitride (AlN), and silicon carbide (SiC). The hard ceramic phase particles may be monodisperse, wherein all of the hard ceramic phase particles are of substantially the same size, or may be polydisperse, wherein the hard ceramic phase particles have a range of sizes and are averaged. The matrix of metal material may, for example, comprise any of the metals or metal alloys previously mentioned herein. In some embodiments, the downhole component 202 is formed of and includes a ceramic-metal composite material comprising WC particles dispersed throughout a matrix of Ni.

The downhole component 202 may be conditioned to improve one or more properties thereof (e.g., thermal resistance, hardness, toughness, chemical resistance, wear resistance, friction coefficient, mechanical strength, etc.) prior to performing the electrochemical boronizing process of the disclosure. By way of non-limiting example, at least a portion of the downhole component 202 may be subjected to a conventional carburization process prior to being provided into the molten electrolyte 206 within the crucible 204. The downhole component 202 may, for example, comprise an at least partially carburized metal material, such as an at least partially carburized metal (e.g., Fe, Ni, Co, W, Ti, Mo, Nb, V, Hf, Ta, Cr, Zr, Al, etc.), and/or an at least partially carburized metal alloy (e.g., an Fe-containing alloy, a Ni-containing alloy, a Co-containing alloy, an Fe- and Ni-containing alloy, a Co- and Ni-containing alloy, an Fe- and Co-containing alloy, an Al-containing alloy, a Cu-containing alloy, a Mg-containing alloy, a Ti-containing alloy, etc.). In some embodiments, the downhole component 202 comprises a carburized Fe-containing alloy (e.g., a carburized steel alloy). In additional embodiments, the downhole component 202 comprises a carburized ceramic-metal composite material.

In some embodiments, the downhole component 202 may include a downhole component 202 that has previously been boronized, used in a downhole environment for a period of time, and desired to be re-boronized.

The downhole component 202 may be cleaned prior to performing the electrochemical boronizing process of the disclosure. For example, at least a portion of the downhole component 202 may be subjected to a conventional cleaning process (e.g., a conventional volatilization process) prior to being provided into the molten electrolyte 206 within the crucible 204. The cleaning process may remove anomalies (e.g., attached materials, structures, etc.) from one or more surface(s) of the downhole component 202 that may otherwise impede or even prevent desired boronization of the downhole component 202.

The downhole component 202 may have a substantially homogeneous distribution of the metal material, or may include a substantially heterogeneous distribution of the metal material. As used herein, the term "homogeneous distribution" means that amounts of a material (e.g., the metal material) do not vary throughout the component. For example, if the downhole component 202 includes a substantially homogeneous distribution of the metal material, amounts of the metal material may not vary throughout the downhole component 202. The downhole component 202 may, for example, comprise a bulk structure of the metal material. In contrast, as used herein, the term "heterogeneous distribution" means amounts of a material (e.g., a metal material) vary within a component. Amounts of the material may vary stepwise (e.g., change abruptly), or may vary continuously (e.g., change progressively, such as linearly, parabolically, etc.) within the component. For example, if the downhole component 202 includes a substantially heterogeneous distribution of the metal material, amounts of the metal material may vary within the downhole component 202. The downhole component 202 may, for example, include a coating of the metal material on another material. If the downhole component 202 includes a ceramic-metal composite material, the downhole component 202 may have a substantially homogeneous distribution of the ceramic-metal composite material, or may have a substantially heterogeneous distribution of the ceramic-metal composite material. In addition, the ceramic-metal composite material may include a substantially homogeneous distribution of the hard ceramic phase particles, or may include a substantially heterogeneous distribution of the hard ceramic phase particles.

Regardless of whether the metal material (and/or the ceramic-metal composite material) is homogeneously distributed or heterogeneously distributed, the downhole component 202 may include at least one metal-containing surface 208. As used herein, the term "metal-containing surface" means and includes a surface at least partially formed of and including the metal material (e.g., Fe, Ni, W, Re, Co, Cu, Ti, Mo, Nb, V, Hf, Ta, Cr, Zr, Si, alloys thereof, combinations thereof, etc.). The metal-containing surface 208 may, for example, comprise at least one of an Fe-containing surface, an Ni-containing surface, a Co-containing surface, and a W-containing surface. The metal-containing surface 208 may be substantially free of anomalies (e.g., attached materials, structures, etc.) that may otherwise impede or even prevent desired boronization of the metal-containing surface 208. The metal-containing surface may be converted to a metal boride-containing surface upon exposure to the electrochemical boronizing process, as described in further detail below. As used herein, the term "metal boride-containing surface" means and includes a surface at least partially formed of and including the metal boride material (e.g., an Fe boride, such as FeB, and/or $Fe_2B$; a Ni boride, such as NiB, $Ni_2B$, $Ni_3B$ and/or $Ni_4B_3$; a W boride, such as WB, $WB_2$, $W_2B_5$, and/or $WB_4$; a Re boride, such as $ReB_2$; a Co boride, such as CoB, $Co_2B$, and/or $Co_3B$; a Cu boride; a Ti boride, such as TiB, and/or $TiB_2$; a Mo boride, such as MoB, $Mo_2B$, $MoB_2$, $Mo_2B_5$, and/or $MoB_4$; a Nb boride, such as NbB, and/or $NbB_2$; a V boride, such as VB, $VB_2$, and/or $V_2B_5$; a Hf boride, such as $HfB_2$; a Ta boride, such as $TaB_2$; a Cr boride, such as CrB, and/or $Cr_2B$; a Zr boride, such as $ZrB_2$; a Si boride; combinations thereof; etc.). In some embodiments, each surface of the downhole component 202 comprises a metal-containing surface. In additional embodiments, the downhole component 202 includes at least one metal-containing surface and at least one non-metal-containing surface. By way of non-limiting example, an outer surface of the downhole component 202 may comprise a metal-containing surface, and an inner surface of the downhole component 202 may comprise a non-metal-containing surface.

An entirety of the metal-containing surface 208 of the downhole component 202 may be exposed to the molten electrolyte 206, or less than an entirety of the metal-containing surface 208 of the downhole component 202 may be exposed to the molten electrolyte 206. For example, at least one portion of the metal-containing surface 208 of the downhole component 202 may be covered or masked to substantially limit or prevent the boronization thereof during the electrochemical boronizing process. As another example, only a portion of the metal-containing surface 208 of the downhole component 202 may be provided (e.g., immersed, submerged, soaked, etc.) in the molten electrolyte 206. In some embodiments, an entirety of the metal-containing surface 208 of the downhole component 202 is exposed to the molten electrolyte 206 in the crucible 204.

With continued reference to FIG. 2, electrical current may be applied to the electrochemical cell 200 to boronize the downhole component 202. By way of non-limiting example, in embodiments in which the molten electrolyte 206 comprises anhydrous $B_2O_3$ and NaOH, the applied electrical current may facilitate the extraction and diffusion of boron atoms into the at least the metal-containing surface 208 of the downhole component 202 through the following reactions:

$$NaOH \rightarrow Na^+ + OH^- \quad (1),$$

$$Na^+ + e^- \rightarrow Na \quad (2),$$

$$6Na + 2B_2O_3 \rightarrow 3Na_2O_2 + 4B \quad (3).$$

Figure 3:
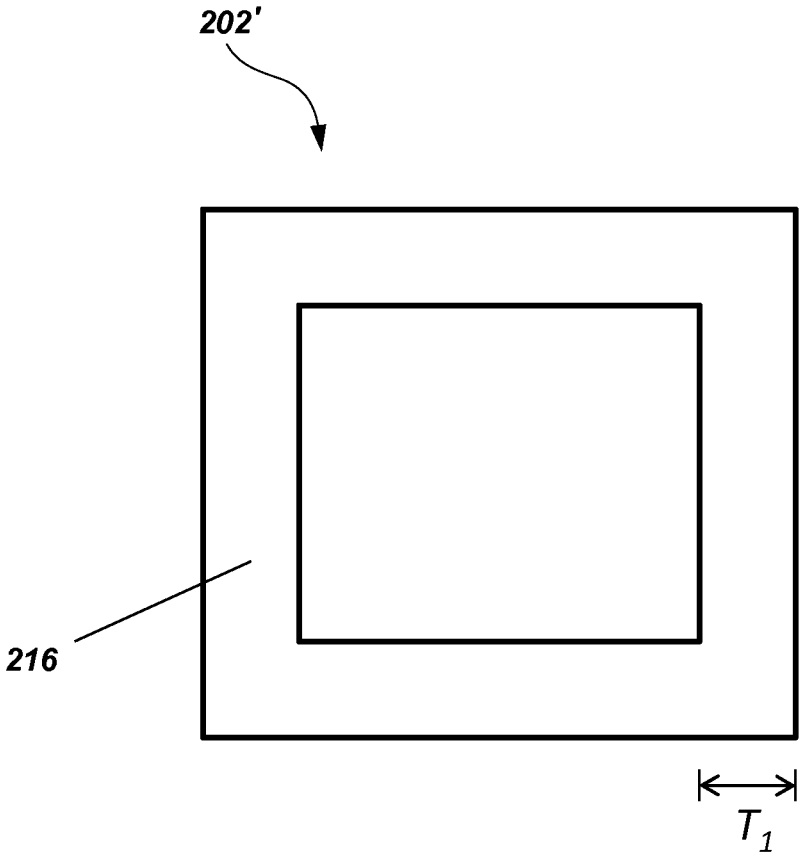
FIG. 3 is a simplified cross-sectional view of a borided downhole component, formed in accordance with an embodiment of the disclosure.

In additional embodiments the at least one other material of the molten electrolyte 206 may include at least one of LiOH, KOH, $Mg(OH)_2$, $Ca(OH)_2$, LiCl, NaCl, KCl, $MgCl_2$, $CaCl_2$, $Li_2CO_3$, $Na_2CO_3$, $K_2CO_3$, $MgCO_3$, and $CaCO_3$. The at least one other material may enhance or accelerate the extraction and deposition of boron atoms from the boron-containing material. The boron atoms may diffuse into the downhole component 202 to form a boronized downhole component 202' including at least one metal boride material 216, as depicted in FIG. 3. As a non-limiting example, if the downhole component 202 is formed of and includes an Fe-containing alloy (e.g., a steel alloy, such as AISI 4815 alloy steel, AISI 4130M7 alloy steel, AISI 4140 alloy steel, AISI 4145H alloy steel, AISI 4715 alloy steel, AISI 8620 alloy steel, AISI 8630 alloy steel, SAE PS55 alloy steel, P550 alloy steel, P650 alloy steel, P750 alloy steel, INCONEL® 945, INCONEL® 925, INCONEL® 745, etc.), the liberated boron atoms may diffuse into the downhole component 202 (FIG. 2) and associate with (e.g., bond with) the Fe atoms thereof to form a metal boride material 216 comprising at least one Fe boride phase through the following reactions:

$$2Fe + B \rightarrow Fe_2B \quad (4),$$

$$Fe_2B + B \rightarrow 2FeB \quad (5).$$

As another non-limiting example, if the downhole component 202 is formed of and includes a ceramic-metal composite material (e.g., WC particles in a matrix of a metal material, such as a matrix of Ni), the liberated boron atoms may diffuse into the downhole component 202 (FIG. 2) and associate with the metal atoms of at least one of the hard ceramic phase particles and the matrix of metal material to form a metal boride material 216 comprising hard ceramic phase particles in a matrix of at least one metal boride (e.g., WC particles in a matrix of at least one of a Ni boride and a W boride).

The metal boride material 216 may comprise a single layer of material, or may comprise multiple layers of material. If the metal boride material 216 comprises a single layer of material, the single layer of material may comprise multiple metal boride phases (e.g., $Fe_2B$ and FeB), or may comprise a single metal boride phase (e.g., $Fe_2B$ or FeB). In addition, if the metal boride material 216 comprises multiple layers of material, at least one of the layers may include a different amount of at least one metal boride phase (e.g., $Fe_2B$ or FeB) than at least one other of the layers. The metal boride material 216 may include a gradient of boride with, for example, a decreasing amount of the metal boride material 216 from a surface of the downhole component 202 to portions of the downhole component 202 away from the surface. In yet other embodiments, an amount of one metal boride phase (e.g., FeB) may decrease from the surface to portions within the downhole component 202 while an amount of at least another metal boride phase (e.g., $Fe_2B$) increases from the surface to portions within the downhole component 202. The metal boride material 216 may also comprise multiple metal borides. For example, if the downhole component 202 is formed of and includes an Fe-containing alloy including Cr, the metal boride material 216 may comprise at least one Fe boride (e.g., $Fe_2B$ and/or FeB) and at least one Cr boride (e.g., $Cr_2B$ and/or CrB). As another example, if the downhole component 202 is formed of and includes a ceramic-metal composite material including WC particles dispersed in a matrix of Ni, the metal boride material 216 may comprise WC particles within a matrix of at least one Ni boride and at least one W boride.

With reference to FIG. 3, electrical current may be applied to the electrochemical cell 200 (FIG. 2) for a sufficient period of time to boronize the metal boride material 216 to a desired thickness $T_1$, such as a thickness $T_1$ within a range of from about one micrometer (μm) to about 500 micrometers (μm). The duration of the applied electrical current, and the resulting thickness $T_1$ and material composition of the metal boride material 216 may at least partially depend on the material composition of the downhole component 202 (FIG. 2), the material composition and temperature of the molten electrolyte 206 (FIG. 2), and the applied current density. By way of non-limiting example, the applied current density may be within a range extending from about 50 milliamperes per square centimeter ($mA/cm^2$) to about 700 $mA/cm^2$ (e.g., from about 100 $mA/cm^2$ to about 500 $mA/cm^2$, from about 100 $mA/cm^2$ to about 300 $mA/cm^2$, or from about 100 $mA/cm^2$ to about 200 $mA/cm^2$), and the duration of the applied electrical current may be within a range extending from about one minute to about fifteen hours (e.g., from about one minute to about two hours, from about one minute to about one hour, from about one hour to about five hours, from about five hours to about ten hours, or from about ten hours to about fifteen hours). In some embodiments, the current density is within a range extending from about 100 $mA/cm^2$ to about 200 $mA/cm^2$, and the duration of the applied electrical current is within a range of from about one minute to about two hours.

Following the boriding of the downhole component 202 (FIG. 2), the applied electrical current may be discontinued, and the borided downhole component 202' may, optionally, be kept in the molten electrolyte 206 (FIG. 2) for an additional period of time. Keeping the borided downhole component 202' in the molten electrolyte 206 in the absence of the applied electrical current (i.e., without any polarization) may facilitate phase homogenization in the metal boride material 216. By way of non-limiting example, in embodiments where the metal boride material 216 comprises an $Fe_2B$ phase and an FeB phase (e.g., in a single layer, in separate layers, or a combination thereof), keeping the borided downhole component 202' in the molten electrolyte 206 for an additional period of time may enable at least a portion of the FeB phase of the metal boride material 216 to be converted to the $Fe_2B$ phase. As compared to the FeB phase, the $Fe_2B$ phase may exhibit properties (e.g., improved toughness, improved hardness, etc.) favorable to the use of the borided downhole component 202' in downhole applications. In some embodiments, substantially all of the FeB phase may be converted to the $Fe_2B$ phase. As a non-limiting example, after discontinuing the applied electrical current, the borided downhole component 202' may be kept in the molten electrolyte 206 for a period of time within a range extending from about ten minutes to about two hours (e.g., from about fifteen minutes to about forty-five minutes, or from about fifteen minutes to about thirty minutes). In additional embodiments, the borided downhole component 202' may be removed from the molten electrolyte 206 without keeping the borided downhole component 202' in the molten electrolyte 206 for the additional period of time (i.e., without keeping the borided downhole component 202' in the molten electrolyte 206 for a period of time greater than or equal to about ten minutes). In further embodiments, the borided downhole component 202' may be removed from the molten electrolyte 206 without keeping the borided downhole component 202' in the molten electrolyte 206 for the additional period of time, and may be provided into a different device or apparatus (e.g., a high temperature furnace) configured and operated to facilitate phase homogenization in the metal boride material 216.

The borided downhole component 202' may be removed from the crucible 204 (and the fixture 214), and may, optionally, be subjected to additional processing or conditioning. Additional processing may, for example, be utilized to enhance one or more properties of the borided downhole component 202' (e.g., thermal resistance, hardness, toughness, chemical resistance, corrosion resistance, wear resistance, lower friction coefficient, mechanical strength, etc.). By way of non-limiting example, at least a portion of the borided downhole component 202' may be subjected to a conventional carburization process. For example, borided portions of the borided downhole component 202' may be covered or masked, and at least one non-borided portion of the borided downhole component 202' may be conventionally carburized. The additional processing may also be utilized to prepare (e.g., shape, size, condition, etc.) the borided downhole component 202' to be secured to at least one other component to form a desired downhole tool (e.g., an earth-boring rotary drill bit, an expandable reamer, an expandable stabilizer, a fixed stabilizer, a rotor, a stator, a pump, a valve, etc.). The additional processing may include subjecting the borided downhole component 202' to a conventional cleaning process (e.g., a conventional volatilization process). Other additional processing acts may include quenching, tempering, or heat treating the borided downhole component 202'.

The borided downhole component 202' may be secured to (e.g., directly or indirectly attached to, provided within, etc.) at least one other component to form a desired borided downhole tool (e.g., the borided downhole tool 108 previously described in relation to FIG. 1). The other component may be substantially the same as the borided downhole component 202' (e.g., may exhibit substantially the same shape, size, and material configuration as the borided downhole component 202'), or may be different than the borided downhole component 202' (e.g., may exhibit at least one of a different shape, a different size, and a different material configuration than the borided downhole component 202'). For example, the other component may comprise another borided downhole component, or may comprise a non-borided downhole component (i.e., a component substantially free of at least one metal boride material). If the other component comprises another borided downhole component, the other component may have substantially the same shape, size, and material configuration as the borided downhole component 202', or may have at least one of a different shape, different size, and different material configuration than the borided downhole component 202'. In some embodiments, the other component exhibits a different thickness of a metal boride material than the borided downhole component 202'.

The borided downhole tool (e.g., the borided downhole tool 108 previously described in relation to FIG. 1) including the borided downhole component 202' may be secured (i.e., directly secured, or indirectly secured) to at least one other downhole tool to form a borided downhole assembly (e.g., the borided downhole assembly 100 previously described in relation to FIG. 1).

The methods of the disclosure facilitate the fast, simple, cost-effective, and environmentally friendly boronization of downhole components, tools, and assemblies able to withstand the aggressive environmental conditions (e.g., abrasive materials, corrosive chemicals, high temperatures, high pressures, etc.) frequently experienced in downhole applications (e.g., drilling applications, conditioning applications, logging applications, measurement applications, monitoring applications, etc.). The borided downhole components, tools, and assemblies formed by the methods of the disclosure may also exhibit improved properties (e.g., metal boride material thickness and homogeneity, hardness, toughness, chemical resistance, etc.) as compared to borided downhole components formed by many conventional boronizing processes. As a result, the methods of the disclosure may be used to boronize downhole components, tools, and assemblies more rapidly and uniformly, improving production efficiency and increasing the quality and longevity of the downhole components, tools, and assemblies produced.

Although the methods disclosed herein describe boronizing components of a downhole tool or assembly, the methods may be used to boronize a metal material. The methods may be suitable for boronizing metals used in automotive components, aerospace components, heavy equipment, the textile industry, or in any metal where it may be desired to form a wear resistant metal surface.

Additional non-limiting example embodiments of the disclosure are set forth below.

Embodiment 1: A method of boriding a metal, the method comprising forming a molten electrolyte comprising between about five weight percent and about fifty weight percent boron oxide; contacting at least a portion of a metal with the molten electrolyte; and applying electrical current to the at least a portion of the metal while maintaining a temperature of the molten electrolyte below about 700° C. to diffuse boron atoms from the molten electrolyte into a surface of the at least a portion of the metal.

Embodiment 2: The method of Embodiment 1, further comprising formulating the molten electrolyte to comprise between about ten weight percent and about thirty weight percent boron oxide.

Embodiment 3: The method of Embodiment 1 or Embodiment 2, further comprising formulating the molten electrolyte to comprise at least one additional material selected from the group consisting of LiOH, NaOH, KOH, CsOH, $Mg(OH)_2$, $Ca(OH)_2$, $Ba(OH)_2$, LiCl, NaCl, KCl, $MgCl_2$, $CaCl_2$, $Li_2CO_3$, $Na_2CO_3$, $K_2CO_3$, $Cs_2CO_3$, $MgCO_3$, $CaCO_3$, and $BaCO_3$, the at least one additional material constituting between about fifty weight percent and about ninety-five weight percent of the molten electrolyte material.

Embodiment 4: The method of Embodiment 3, further comprising formulating the molten electrolyte to consist essentially of $B_2O_3$ and the at least one additional material.

Embodiment 5: The method of any one of Embodiments 1 through 4, further comprising maintaining a temperature of the molten electrolyte below about 550° C. while applying the electrical current to the at least a portion of the metal.

Embodiment 6: The method of any one of Embodiments 1 through 5, further comprising maintaining a temperature of the molten electrolyte below about 450° C. while applying the electrical current to the at least a portion of the metal.

Embodiment 7: The method of any one of Embodiments 1 through 3, Embodiment 5, or Embodiment 6, further comprising formulating the molten electrolyte to comprise at least one additional material selected from the group consisting of NaOH, KOH, CsOH, $Mg(OH)_2$, and $Ba(OH)_2$, the at least one additional material constituting between about fifty weight percent and about ninety-five weight percent of the molten electrolyte material.

Embodiment 8: The method of any one of Embodiment 1, Embodiment 3, or Embodiments 5 through 7, further comprising formulating the molten electrolyte to comprise between about five weight percent and about ten weight percent $B_2O_3$.

Embodiment 9: The method of any one of Embodiment 1, Embodiment 3, or Embodiments 5 through 7, further comprising formulating the molten electrolyte to comprise between about ten weight percent and about twenty weight percent $B_2O_3$.

Embodiment 10: The method of any one of Embodiments 1 through 9, further comprising selecting the at least a portion of the metal to comprise at least one of Fe, Co, Ni, Cu, W, Re, Ti, Mo, Nb, V, Hf, Ta, Cr, Zr, Al, and Si.

Embodiment 11: The method of any one of Embodiments 1 through 10, wherein contacting at least a portion of a metal with the molten electrolyte comprises contacting a carburized metal alloy with the molten electrolyte.

Embodiment 12: The method of any one of Embodiments 1 through 11, further comprising selecting the metal to comprise a downhole tool component comprising a component of at least one of an earth-boring rotary drill bit, a tooth of a drill bit, a cutting structure of a drill bit, a core bit, a completion tool, an expandable reamer, a fixed blade reamer, an expandable stabilizer, a fixed stabilizer, a slip-on stabilizer, a clamped-on stabilizer, an integral stabilizer, an optimized rotational density tool, a slimhole neutron density tool, a calibrated neutron density tool, a drill motor, a bearing, an upper bearing housing, a lower bearing housing, a rotor, a stator, a pump, and a valve.

Embodiment 13: The method of any one of Embodiments 1 through 12, wherein contacting at least a portion of a metal with the molten electrolyte comprises contacting at least a portion of a downhole tool component with the molten electrolyte.

Embodiment 14: The method of any one of Embodiments 1 through 13, further comprising surrounding the at least a portion of the metal with a plurality of anodes.

Embodiment 15: A method of surface treating a downhole tool component, the method comprising at least partially inserting at least one component comprising metal at least partially into a molten electrolyte comprising between about five weight percent and about thirty weight percent $B_2O_3$ and between about seventy weight percent and about ninety-five weight percent of at least one of LiOH, NaOH, KOH, CsOH, $Mg(OH)_2$, $Ca(OH)_2$, $Ba(OH)_2$, LiCl, NaCl, KCl, $MgCl_2$, $CaCl_2$, $Li_2CO_3$, $Na_2CO_3$, $K_2CO_3$, $Cs_2CO_3$, $MgCO_3$, $CaCO_3$, and $BaCO_3$; and diffusing boron from the molten electrolyte into a surface of the at least one component to form a metal boride on the surface of the at least one component while applying electrical current to the at least one component.

Embodiment 16: The method of Embodiment 15, further comprising selecting the downhole tool component to comprise a component of at least one of an earth-boring rotary drill bit, a tooth of a drill bit, a cutting structure of a drill bit, a core bit, a completion tool, an expandable reamer, a fixed blade reamer, an expandable stabilizer, a fixed stabilizer, a slip-on stabilizer, a clamped-on stabilizer, an integral stabilizer, an optimized rotational density tool, a slimhole neutron density tool, a calibrated neutron density tool, a drill motor, a bearing, an upper bearing housing, a lower bearing housing, a rotor, a stator, a pump, and a valve.

Embodiment 17: The method of Embodiment 15 or Embodiment 16, further comprising maintaining a temperature of the molten electrolyte below about 700° C. while applying the electrical current to the at least one component.

Embodiment 18: The method of any one of Embodiments 15 through 17, further comprising maintaining a temperature of the molten electrolyte below about 550° C. while applying the electrical current to the at least one component.

Embodiment 19: The method of any one of Embodiments 15 through 18, further comprising formulating the molten electrolyte to comprise between about twenty weight percent and about thirty weight percent $B_2O_3$.

Embodiment 20: A downhole tool, comprising at least one borided component comprising a metal and having a surface treated by the method comprising forming a molten electrolyte comprising between about five weight percent and about fifty weight percent boron oxide; contacting at least a portion of a downhole tool component with the molten electrolyte; and applying electrical current to the at least a portion of the downhole tool component while maintaining a temperature of the molten electrolyte below about 700° C. to diffuse boron atoms from the molten electrolyte into a surface of the at least a portion of the downhole tool component.

Although the foregoing description contains many specifics, these are not to be construed as limiting the scope of the disclosure, but merely as providing certain embodiments. Similarly, other embodiments may be devised that do not depart from the scope of the invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to embodiments of the disclosure, as described and illustrated herein, which fall within the meaning and scope of the claims, are encompassed by the invention.

What is claimed is:

1. A method of boriding a metal, the method comprising:

forming a molten electrolyte comprising between about five weight percent and about fifty weight percent boron oxide and between about fifty weight percent and about ninety-five weight percent of at least one additional material, the at least one additional material selected from the group consisting of NaOH, KOH, CsOH, $Mg(OH)_2$, and $Ba(OH)_2$;

contacting at least a portion of a metal selected from the group consisting of at least one of Fe, Co, Ni, Cu, W, Re, Ti, Mo, Nb, V, Hf, Ta, Cr, Zr, Al, carbides thereof, nitrides thereof, oxides thereof, and alloys thereof with the molten electrolyte; and applying electrical current to the at least a portion of the metal while maintaining a temperature of the molten electrolyte below about 650° C. to diffuse boron atoms from the molten electrolyte into a surface of the at least a portion of the metal.

2. The method of claim 1, further comprising formulating the molten electrolyte to comprise between about ten weight percent and about thirty weight percent boron oxide.

3. The method of claim 1, further comprising formulating the molten electrolyte to consist essentially of $B_2O_3$ and the at least one additional material.

4. The method of claim 1, further comprising maintaining a temperature of the molten electrolyte below about 550° C. while applying the electrical current to the at least a portion of the metal.

5. The method of claim 4, further comprising maintaining a temperature of the molten electrolyte below about 450° C. while applying the electrical current to the at least a portion of the metal.

6. The method of claim 1, further comprising formulating the molten electrolyte to comprise between about five weight percent and about ten weight percent $B_2O_3$.

7. The method of claim 1, further comprising formulating the molten electrolyte to comprise between about ten weight percent and about twenty weight percent $B_2O_3$.

8. The method of claim 1, wherein contacting at least a portion of a metal with the molten electrolyte comprises contacting a carburized metal alloy with the molten electrolyte.

9. The method of claim 1, further comprising selecting the metal to comprise a downhole tool component comprising a component of at least one of an earth-boring rotary drill bit, a tooth of a drill bit, a cutting structure of a drill bit, a core bit, a completion tool, an expandable reamer, a fixed blade reamer, an expandable stabilizer, a fixed stabilizer, a slip-on stabilizer, a clamped-on stabilizer, an integral stabilizer, an optimized rotational density tool, a slimhole neutron density tool, a calibrated neutron density tool, a drill motor, a bearing, an upper bearing housing, a lower bearing housing, a rotor, a stator, a pump, and a valve.

10. The method of claim 1, wherein contacting at least a portion of a metal with the molten electrolyte comprises contacting at least a portion of a downhole tool component with the molten electrolyte.

11. The method of claim 1, further comprising surrounding the at least a portion of the metal with a plurality of anodes.

12. A method of surface treating a downhole tool component, the method comprising:

at least partially inserting at least one component comprising metal at least partially into a molten electrolyte comprising between about five weight percent and about thirty weight percent $B_2O_3$ and between about seventy weight percent and about ninety-five weight percent of at least one of LiOH, NaOH, KOH, CsOH, $Mg(OH)_2$, $Ca(OH)_2$, $Ba(OH)_2$, LiCl, NaCl, KCl, $MgCl_2$, $CaCl_2$, $Li_2CO_3$, $Na_2CO_3$, $K_2CO_3$, $Cs_2CO_3$, $MgCO_3$, $CaCO_3$, and $BaCO_3$;

diffusing boron from the molten electrolyte into a surface of the at least one component to form a metal boride on the surface of the at least one component while applying electrical current to the at least one component and maintaining a temperature of the molten electrolyte between about 400° C. and about 700° C.; and carburizing at least a portion of the at least one component after forming the metal boride on the surface of the at least one component.

13. The method of claim 12, further comprising selecting the downhole tool component to comprise a component of at least one of an earth-boring rotary drill bit, a tooth of a drill bit, a cutting structure of a drill bit, a core bit, a completion tool, an expandable reamer, a fixed blade reamer, an expandable stabilizer, a fixed stabilizer, a slip-on stabilizer, a clamped-on stabilizer, an integral stabilizer, an optimized rotational density tool, a slimhole neutron density tool, a calibrated neutron density tool, a drill motor, a bearing, an upper bearing housing, a lower bearing housing, a rotor, a stator, a pump, and a valve.

14. The method of claim 12, further comprising maintaining a temperature of the molten electrolyte below about 550° C. while applying the electrical current to the at least one component.

15. The method of claim 12, further comprising formulating the molten electrolyte to comprise between about twenty weight percent and about thirty weight percent $B_2O_3$.

16. A downhole tool, comprising:

at least one borided component comprising a metal and having a surface treated by the method comprising:

forming a molten electrolyte comprising between about five weight percent and about thirty weight percent boron oxide and between about seventy weight percent and about ninety-five weight percent of at least one additional material selected from the group consisting of LiOH, NaOH, KOH, CsOH, $Mg(OH)_2$, $Ca(OH)_2$, $Ba(OH)_2$, LiCl, NaCl, KCl, $MgCl_2$, $CaCl_2$, $Li_2CO_3$, $Na_2CO_3$, $K_2CO_3$, $Cs_2CO_3$, $MgCO_3$, $CaCO_3$, and $BaCO_3$;

contacting at least a portion of a downhole tool component with the molten electrolyte;

applying electrical current to the at least a portion of the downhole tool component while maintaining a temperature of the molten electrolyte below about 700° C. to diffuse boron atoms from the molten electrolyte into a surface of the at least a portion of the downhole tool component; and carburizing at least a portion of the at least one component after forming the metal boride on the surface of the at least one component.

17. The method of claim 12, wherein diffusing boron from the molten electrolyte into a surface of the at least one component to form a metal boride on the surface of the at least one component comprises forming a gradient of boride from the surface of the at least one component to portions of the at least one component away from the surface.

18. The method of claim 12, wherein diffusing boron from the molten electrolyte into a surface of the at least one component to form a metal boride on the surface of the at least one component comprises forming the metal boride to a thickness of between 1 μm and 500 μm on the surface of the at least one component.

19. The method of claim 12, further comprising maintaining a temperature of the molten electrolyte below about 450° C. while applying the electrical current to the at least one component.

* * * * *